US008619505B2

(12) United States Patent
Burton et al.

(10) Patent No.: US 8,619,505 B2
(45) **Date of Patent: *Dec. 31, 2013**

(54) USER INTERFACE FEATURES FOR A WATCH

(71) Applicant: NIKE, Inc., Beaverton, OR (US)

(72) Inventors: Maximillian P. Burton, Portland, OR (US); James Alec Ishihara, Beaverton, OR (US); Michael Prstojevich, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/646,810

(22) Filed: Oct. 8, 2012

(65) Prior Publication Data

US 2013/0148477 A1 Jun. 13, 2013

Related U.S. Application Data

(63) Continuation of application No. 13/329,866, filed on Dec. 19, 2011, now Pat. No. 8,284,634, which is a continuation of application No. 13/011,277, filed on Jan. 21, 2011, now Pat. No. 8,125,855, which is a continuation of application No. 11/686,338, filed on Mar. 14, 2007, now Pat. No. 7,898,906.

(51) Int. Cl.
*G04F 8/00* (2006.01)

(52) U.S. Cl.
USPC ..... 368/113

(58) Field of Classification Search
USPC ..... 368/62, 82–84, 107, 113
See application file for complete search history.

(56) References Cited

U.S. PATENT DOCUMENTS

| | | | | |
|---|---|---|---|---|
| 4,640,624 | A | 2/1987 | Pitt | |
| 4,831,605 | A * | 5/1989 | Suga | 368/113 |
| 4,991,156 | A | 2/1991 | Suga | |
| 5,050,141 | A | 9/1991 | Thinesen | |
| 5,229,981 | A * | 7/1993 | Maschi | 368/111 |
| 5,257,244 | A | 10/1993 | Thinsen | |
| 5,377,169 | A * | 12/1994 | Reeger et al. | 368/107 |
| 5,408,446 | A * | 4/1995 | Ohira | 368/110 |
| 6,736,759 | B1 | 5/2004 | Stubbs et al. | |
| 6,909,671 | B2 * | 6/2005 | Setler | 368/113 |
| 6,975,563 | B2 | 12/2005 | de Brito | |
| 8,125,855 | B2 * | 2/2012 | Ishihara et al. | 368/113 |
| 8,284,634 | B2 * | 10/2012 | Ishihara et al. | 368/113 |
| 2004/0225467 | A1 | 11/2004 | Vock et al. | |

* cited by examiner

*Primary Examiner* — Edwin A. Leon
(74) *Attorney, Agent, or Firm* — Banner & Witcoff, Ltd.

(57) ABSTRACT

A watch provides a chronographic function while the watch is in a "sport" mode. If a user activates a button relating to the chronographic function, such as a "start/lap" button, then the light for the watch will automatically activate. The light may remain active for a significantly long time, such as a period of six seconds or more. Alternately or additionally, if a user activates a button while the watch is in a "performance" or "sport" mode, then the light will automatically activate regardless of the button being activated. Still further, the chronographic function of the watch may be configured to not measure a lap time that is lower than a preset threshold value, such as, for example, three seconds.

20 Claims, 5 Drawing Sheets

USER INTERFACE FEATURES FOR A WATCH

RELATED APPLICATIONS

This application is a continuation of U.S. patent application Ser. No. 13/329,866 filed Dec. 19, 2011, which is a continuation of U.S. patent application Ser. No. 13/011,277 filed Jan. 21, 2011, now U.S. Pat. No. 8,125,855, which is a continuation of U.S. patent application Ser. No. 11/686,338 filed Mar. 14, 2007, now U.S. Pat. No. 7,898,906, the disclosures of which are hereby incorporated by reference in their entireties.

FIELD OF THE INVENTION

The present invention relates to user interface features for a watch. Various implementations of the invention may be particularly useful for controlling the operation of a user interface while a user is employing the watch to measure his or her athletic performance, such as with a chronographic function of the watch.

BACKGROUND OF THE INVENTION

In order to analyze their performance in a quantifiable manner, athletes will often measure various performance information. One class of performance information includes time parameters corresponding to an athlete's travel over a distance. For example, a runner may measure the total elapsed time required to run a distance, the elapsed time required to run a segment of a distance, and/or the average time required to run equal segments of a distance. Another class of performance information relates to the athlete's own physical parameters. Thus, an athlete may measure his or her heart rate, body temperature, blood pressure, or volumetric expansion of his or her lungs while performing an activity like running or biking. In many situations, and particularly with regard to measuring the total elapsed time required to run a distance or the elapsed time required to run a segment of a distance (e.g., a "lap" time or a "split" time), an athlete will use a watch to measure the desired performance information.

Accordingly, some conventional watches for athletic use may have a variety of different operational modes for measuring and displaying different types of information, including performance information. For example, a watch may have a time or chronometer mode for displaying the current time in the user's time zone (and, with some watches, the current time in one or more other time zones). The same watch may also have a performance mode (sometimes referred to as a "sport" mode or "run" mode) in which the watch's primary operation is measuring and/or displaying performance information. For example, in the performance mode, a watch may execute a chronographic function for measuring both a total elapsed time and individual segments of a total elapsed time (each segment of the total elapsed time being, for example, the amount of time required to travel a segment of a total distance). Still further, if the watch operates in conjunction with a sensor, such as a speed/distance monitor, heart rate monitor, blood-oxygen content monitor or the like, then the watch may receive and display performance information from a sensor or sensors in the performance mode. A watch also may have, e.g., an alarm mode for activating and scheduling an alarm. It may also have a data mode for accessing and displaying stored measured athletic information, such as previously recorded lap times.

Typically, however, a conventional watch will not modify the operation of its user interface to accommodate some of the special circumstances involved when a user is employing the watch to measure or display his or her athletic performance. For example, while many watches provide a light button for illuminating the watch's display, this button may be very difficult for a user to simultaneously depress with another button that may need to be activated to view a desired athletic performance measurement. For example, if a user operating a conventional watch at night wishes to view the time that elapsed while he or she ran a distance or a segment of a distance, then the user must simultaneously depress both a "light" button and a "start/lap" button. Even if the user can accomplish this simultaneous button activation while running, the light may not remain on long enough for the user to view all of the information displayed by the watch (e.g., in response to the activation of a "lap" button, some watches will display both a total elapsed time and the most recently measured lap time or split time).

Also, the watch may be configured to blindly measure an athletic performance value that is unrealistic or even impossible. For example, a user may employ a conventional watch to measure the time that elapsed while he or she ran a segment of a distance (i.e., a "lap" time or a "split" time) while continuing to measure a total elapsed time required to travel the total distance. If the user inadvertently depresses the "start/lap" button (while, for example, attempting to simultaneously depress a "light" button), then the watch will automatically record and display the lap time or split time when the button is depressed, even if that lap time is too low for the user to have run a distance segment of any significant length.

BRIEF SUMMARY OF THE INVENTION

Various aspects of the invention relate to improved user interface features for a watch. According to some implementations of the invention, a watch will provide a chronographic function or another function for measuring or displaying performance information while the watch is in a "performance" or "sport" mode. If a user activates a button while the watch is in the "performance" mode, such as a "start/lap" button relating to a chronographic function, then the light for the watch will automatically activate. With some implementations of the invention, the light may remain active for a significantly long time, such as a period of six seconds or more. According to still other examples of the invention, the chronographic function of the watch will not measure a lap time or split time that is lower than a preset threshold value, such as, for example, three seconds.

DETAILED DESCRIPTION OF THE INVENTION

Operating Environment

Figure 1:
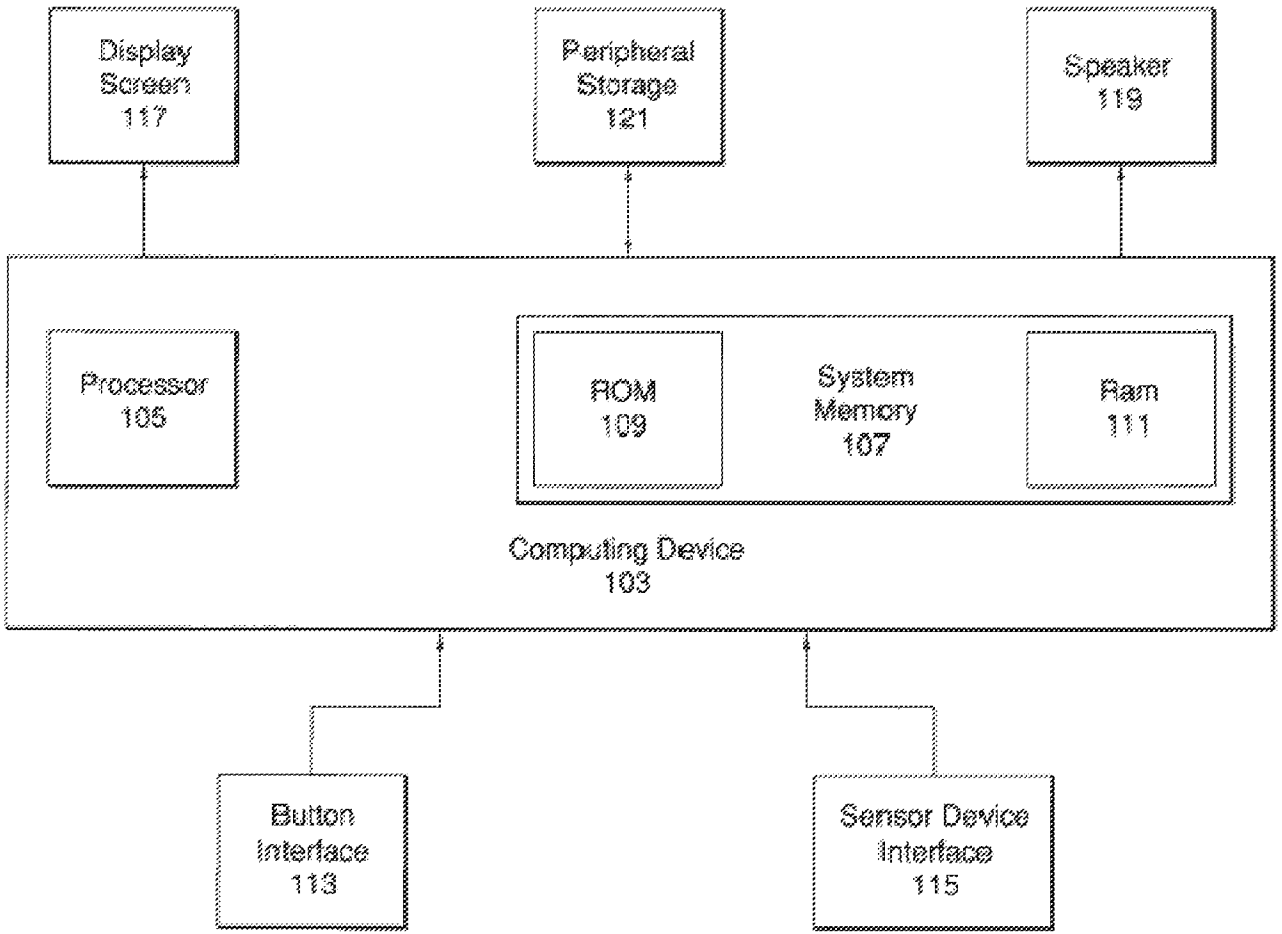
FIG. 1 is a block diagram of components of an electronic console according to various embodiments of the invention.

A watch (or other athletic performance measurement device) according to various examples of the invention may be implemented using mechanical components, electronic components (including both analog and digital components), or some combination thereof. Typically, however, many examples of the invention will be implemented using electronic components, including digital electronic components. Accordingly, FIG. 1 illustrates an example of a general-purpose computer system that can be used to implement a watch (or other athletic performance measurement device) according to various aspects of the invention.

In this figure, the computer system 101 has a computing device 103 that includes a processor 105, such as a programmable microprocessor, and a system memory 107 coupled to the processor 105. The system memory 107 may employ any appropriate memory device, such as a microcircuit memory device. The system memory 107 will typically include both a read only memory (ROM) 109 and a random access memory (RAM) 111. The ROM 109 and RAM 111 may be connected to the processor 105 using a suitable conventional bus structure (not shown), including a memory bus or memory controller, a peripheral bus, and a local bus using any of a variety of bus architectures.

The computer system 101 will also include one or more input devices. For example, the computer system may include a plurality of buttons for controlling the operation of the computer system 101. More particularly, the computer system 101 may include a button interface 113 having a small number of depressible buttons. With some examples of the invention, the system 101 may also have one or more sensor interfaces 115 for providing information to and/or receiving information from sensor devices that measure one or more characteristics of the device's environment. For example, the sensor interfaces 115 may include a wireless transmitter and receiver for both sending and receiving information to and from remote sensors. One or more sensor interfaces 115 may be capable of transmitting and receiving infrared signals, visible light signals, and signals encoded onto radio waves. Alternately, one or more sensor interfaces 115 may be physically connected to a remote sensor by a conductive wire or an optical fiber.

The computer system 101 will typically also include one or more output devices. For example, the computer system 101 may include a display 117, which may be a small liquid crystal display (LCD) screen, and one or more small speakers 119. Of course, the computer system 101 may have additional or alternate input, output, and memory devices as desired. For example, the computer system 101 may include a small peripheral data storage device 121, such as a Memory Stick or a Secure Digital card.

As will be appreciated by those of ordinary skill in the art, the computer system 101 executes instructions stored in the system memory 107. These instructions may be stored and the system memory 107 when the computer system 101 is manufactured, or the instructions may be retrieved to the system memory 107 from one or more peripheral storage devices. In addition, the computer system 101 may receive input data for executing the instructions from a user through one or more of the input devices. The computer system 101 may then output the results obtained by executing the instructions through one or more of the output devices.

Figure 2:
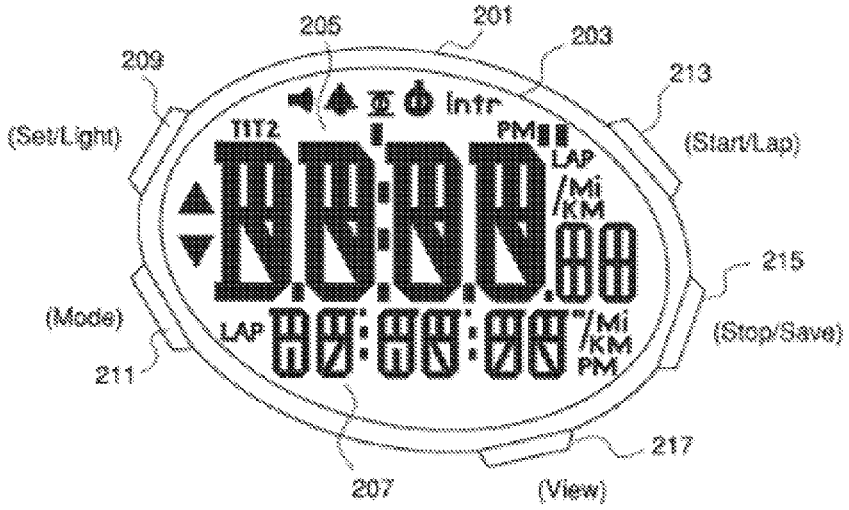
FIG. 2 illustrates a user interface provided by a watch according to various embodiments of the invention.

FIG. 2 illustrates an example of a watch 201 that may be implemented using the computer system 101 described above. As seen in this figure, the watch 201 includes a display 203, which displays data values calculated by, or provided to, the watch 201. More particularly, the display 203 includes a primary display field 205 and a secondary display field 207. The display 203 also includes a variety of icon displays for indicating operation processes of the watch 201. As also seen in this figure, the watch 201 includes five input command buttons 209-217. Activating the first input command button 209, referred to as the "set/light" command button, allows a user to set values that will be used by the watch 201, or to activate a light to illuminate the display 203. The second input command button 211, referred to as the "mode" command button, allows a user to switch between various operational modes of the watch 201. The third input command button 213, referred to as the "start/lap" command button, can be used to, for example, start various functions of the watch 201, such as a chronographic process. If a watch is measuring a total elapsed time during a chronographic process, the "start/lap" command button 213 can be activated to obtain a current lap time without stopping the chronographic measurement of the total elapsed time.

The fourth input command button 215, referred to as the "stop" command button, can be used to, for example, stop various functions of the watch 201, such as the chronographic process. Lastly, the fifth command button 217, referred to as the "view" command button, allows a user to select the information displayed by the watch 201. With various examples of the invention, it may also be used to switch between operational modes of the watch. Of course, one or more of these command buttons 209-217 may also perform alternate functions for various embodiments of the invention. Further, other embodiments of the invention may employ more or fewer command buttons, or may employ alternate input devices altogether for receiving commands from a user.

Minimum Lap Time Restriction

Figure 3:
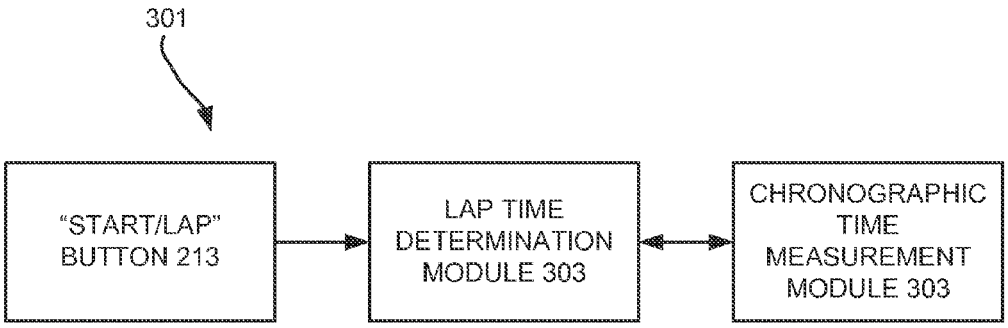
FIG. 3 illustrates components of a watch that may be used to provide a minimum lap time restriction for a chronographic function of the watch according to various embodiments of the invention.
Figure 4:
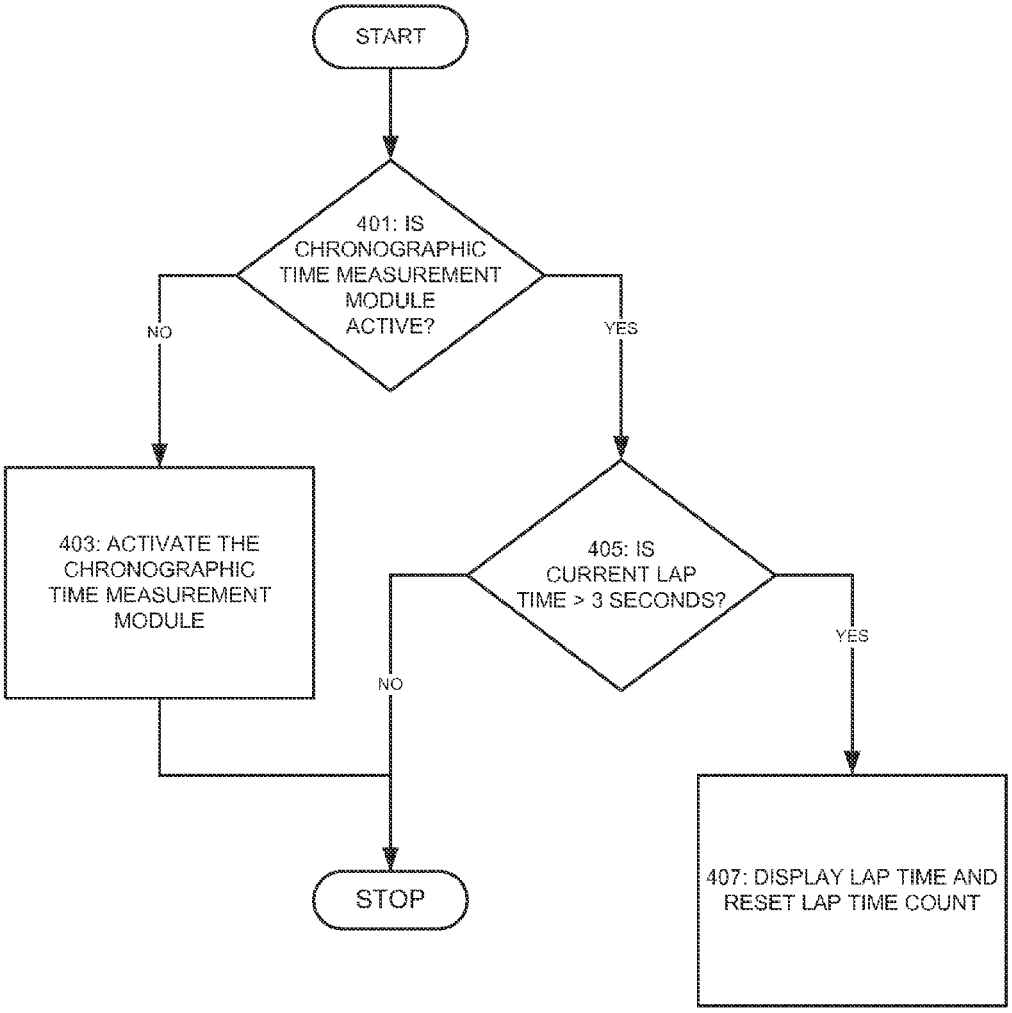
FIG. 4 illustrates a flowchart showing a process for providing a minimum lap time restriction for a chronographic function of a watch according to various embodiments of the invention.

FIG. 3 illustrates components of a watch 301 that may be used to provide a minimum lap time restriction for a chronographic function of the watch. As seen in this figure, the watch 301 includes a "start/lap" button 213, a lap time determination module 303, and a chronographic time measurement module 305. As will be appreciated by those of ordinary skill in the art, the lap time determination module 303 and the chronographic time measurement module 305 may both be implemented by the computing device 103 executing programming instructions. The operation of the watch 301 is shown in the flowchart illustrated in FIG. 4.

As seen in this figure, when the "start/lap" button 213 is depressed the lap time determination module 303 determines in step 401 whether the chronographic time measurement module 305 is currently active (i.e., running a counter to measure a total elapsed time and/or a current lap time). If it is not currently active, then, in step 403, the chronographic time measurement module 303 is activated. If, however, the lap time determination module 303 determines that the chronographic time measurement module 305 is currently active, then, in step 405, the lap time determination module 303 determines if the chronographic time measurement module 305 has counted a current lap time above a defined threshold. For example, the lap time determination module 303 may determine if the chronographic time measurement module 305 has measured a current lap time greater than three seconds. If the lap time determination module 303 determines that the chronographic time measurement module 305 has not counted a current lap time above the defined threshold, then no action is taken and the process ends (i.e., the chronographic time measurement module 305 continues to run a counter measuring a total elapsed time and/or a current lap time without interruption). If, however, the lap time determination module 303 determines that the chronographic time measurement module 305 has counted a current lap time above a defined threshold, then in step 407 the lap time determination module 303 instructs the chronographic time measurement module 305 to display the current lap time and, if appropriate, reset the current lap time value.

In this manner, the watch 301 ensures that its chronographic process does not register an impossible or "false" lap time. Of course, it should be appreciated that, while particular examples of the invention have been described with respect to the calculation and display of lap times, other embodiments of the invention may alternately or additionally ensure that a chronographic process does not register an undesirably low split time in the same manner described above with respect to the measurement of a lap time.

Automatic Light Illumination

Figure 5:
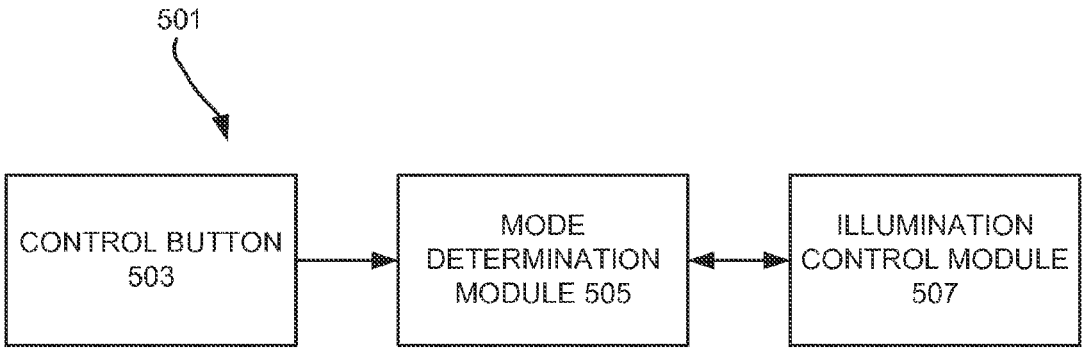
FIG. 5 illustrates components of a watch that may be used to provide an automatic illumination for a watch display when a button relating to a performance mode operation of the watch is activated.
Figure 6:
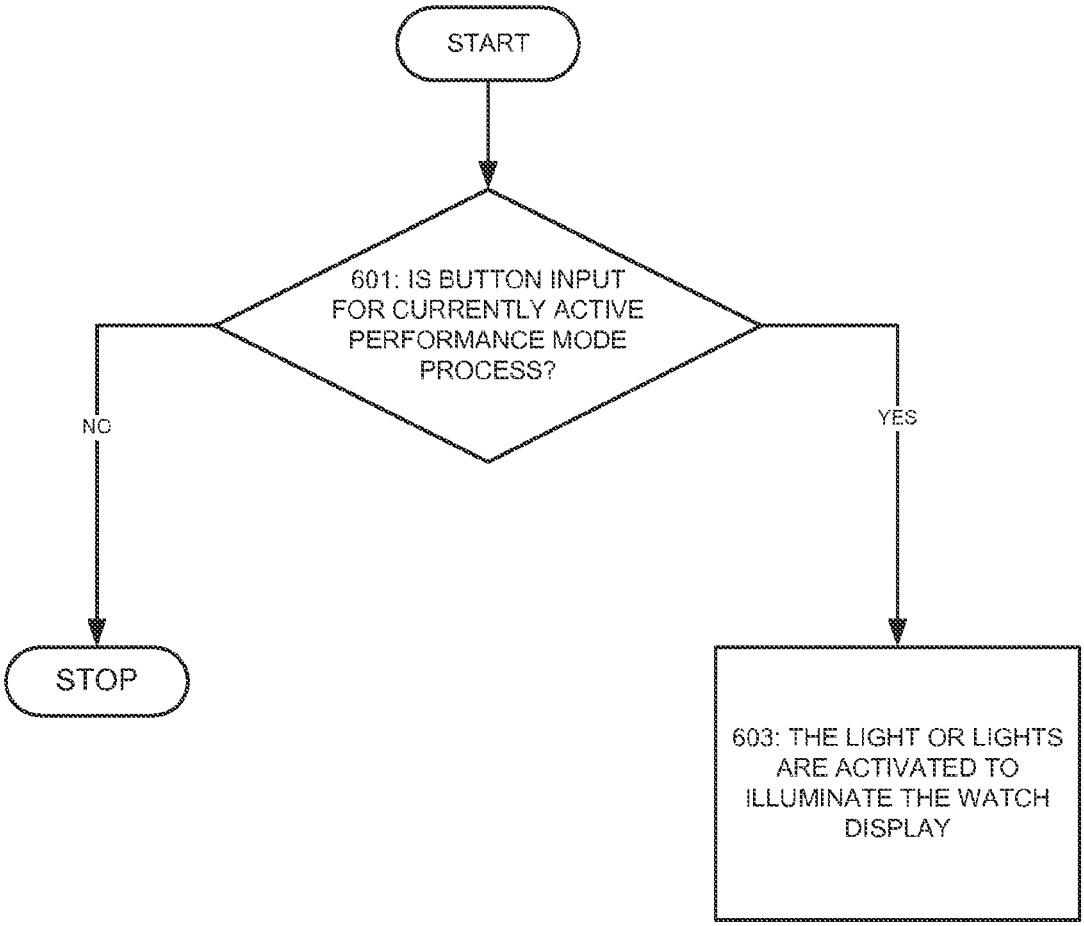
FIG. 6 illustrates a flowchart showing a process for providing an automatic illumination for a watch display when a button relating to a performance mode operation of the watch is activated.

FIG. 5 illustrates components of a watch 501 that may be used to provide an automatic illumination for a watch display when a button relating to a chronographic function of the watch 501, such as a "lap" button, is activated. As seen in this figure, the watch 501 includes a control button 503 for controlling the operation of the watch, such as a "start/lap" button 213. The watch 501 also includes a mode determination module 505 that determines when the watch 501 is operating in a "performance" or "sport" mode. Still further, the watch 501 includes an illumination control module 507. As will be appreciated by those of ordinary skill in the art, the mode determination module 505 and the illumination control module 507 may both be implemented by the computing device 103 executing programming instructions. The operation of the watch 501 is shown in the flowchart illustrated in FIG. 6.

As seen in this figure, when the button 503 is depressed, the mode determination module 505 determines in step 601 whether the activation of button 503 is input for a process that is executing while the watch 501 is currently in a "performance" or "sport" mode. If the mode determination module 505 determines that the activation of the button 503 is not input for a process currently active in a "performance" or "sport" mode of the watch 501 (such as, e.g., a chronographic process), then no action is taken. If, however, the mode determination module 505 determines that activation of the button 503 is input for a process currently active in a "performance" or "sport" mode of the watch 501 (such as, e.g., a "start/lap" button 213 activated to cause a chronographic process to record a lap time), then, in step 603, the mode determination module 505 instructs the illumination control module 507 to activate the light or lights for illuminating the watch display.

With various examples of the invention, the mode determination module 505 may additionally instruct the illumination control module 507 to activate the light or lights for a preset time that is longer than the light or lights would otherwise be activated. For example, the mode determination module 505 may additionally instruct the illumination control module 507 to activate the light or lights for six seconds or, with some embodiments of the invention, an even longer period of time.

In this manner, the watch 501 ensures that the illumination light is activated when a user activates a button to record or display information while the watch 501 is operating in a "performance" or "sport" mode. Of course, it should be appreciated that, while particular examples of the invention have been described where the light or lights are automatically illuminated in response to any button serving as input to a chronographic process, various examples of the invention may automatically activate the light or lights only in response to the activation of the "start/lap" button 213 to record a lap time, as noted above. Still other examples of the invention may alternately automatically activate the light or lights only in response to the activation of a "split" time button depressed to record a split time.

CONCLUSION

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A computer-implemented method comprising:

in a device having a performance mode configured for monitoring athletic performance data and a second mode, and being configured to illuminate a display in both the performance mode and the second mode, detecting selection of the performance mode;

processing input instructing the device to record information relating to an athletic activity while operating in the performance mode; and illuminating the display of the device to present the recorded information in response to the input without receiving separate input to cause the illumination.

2. The method of claim 1, wherein the illuminating of the display is for a preset amount of time.

3. The method of claim 2, wherein the preset amount of time is for six or more seconds.

4. The method of claim 1, further comprising processing second input to cause the device to operate in the second mode.

5. The method of claim 4, further comprising causing illumination of the display in the second mode, wherein the device causes illumination of the display for a longer period of time in the performance mode than in the second mode.

6. The method of claim 1, wherein the recorded information corresponds to monitoring completion of a lap.

7. The method of claim 1, wherein the recorded information corresponds to a split time.

8. The method of claim 7, further comprising: determining that the split time exceeds a predetermined amount prior to recording the split time.

9. A device comprising:

a display;

a processor; and a computer-readable medium comprising computer-executable instructions that when executed cause the processor at least to perform:

detecting selection of a performance mode for monitoring athletic performance;

processing input instructing the device to record information relating to an athletic activity while operating in the performance mode; and illuminating the display to present the recorded information in response to the input without receiving separate input to cause the illumination.

10. The device of claim 9, wherein the illuminating of the display is for a preset amount of time.

11. The device of claim 10, wherein the preset amount of time is for six or more seconds.

12. The device of claim 9, wherein the processor is further configured to process second input to cause the watch to operate a nonperformance mode.

13. The device of claim 12, wherein the processor is further configured to cause illumination of the display in the nonperformance mode, wherein the processor causes illumination of the display for a longer period of time in the performance mode than in the nonperformance mode.

14. The device of claim 9, wherein the recorded information corresponds to monitoring completion of a lap.

15. The device of claim 9, wherein the recorded information corresponds to a split time.

16. A timing device comprising:

a display;

an input button; a processor; and a computer-readable medium comprising computer-executable instructions that, when executed, cause the processor at least to perform:

detecting actuation of the input button;

wherein in response to determining that the timing device is in a performance mode, causing illumination of the display for a first given duration; and wherein in response to determining that the timing device is in a nonperformance mode, causing illumination of the display for a second given duration which is less than the first duration.

17. The timing device of claim 16, wherein the processor is further configured to process input instructing the timing device to record information relating to an athletic activity while operating in the performance mode.

18. The timing device of claim 17, wherein the processor is further configured to cause illumination of the display to present the recorded information in response to the input without receiving separate input to cause the illumination.

19. The timing device of claim 17, wherein the recorded information corresponds to monitoring completion of a lap.

20. The timing device of claim 17, wherein the recorded information corresponds to a split time.

* * * * *